United States Patent [19]

Tompkins et al.

[11] Patent Number: 4,718,496

[45] Date of Patent: Jan. 12, 1988

[54] METHOD AND APPARATUS FOR THE COMPLETION OF AN OIL OR GAS WELL AND THE LIKE

[75] Inventors: Charles R. Tompkins; Michael Pitts, both of Midland, Tex.

[73] Assignee: Dresser Industries, Inc., Dallas, Tex.

[21] Appl. No.: 602

[22] Filed: Jan. 5, 1987

[51] Int. Cl.[4] ..... E21B 33/124; E21B 33/129

[52] U.S. Cl. ..... 166/387; 166/127; 166/147

[58] Field of Search ..... 166/191, 181, 387, 127, 166/147, 337, 117.5, 182

[56] References Cited

U.S. PATENT DOCUMENTS

| | | | |
|---|---|---|---|
| 2,831,541 | 4/1958 | Conover | 166/191 X |
| 3,199,598 | 8/1965 | Loomis | 166/147 |
| 3,455,382 | 7/1969 | Chenoweth | 166/147 |
| 3,735,814 | 5/1973 | Tucker | 166/217 |
| 3,987,847 | 10/1976 | Craig | 166/191 |
| 4,081,990 | 4/1978 | Chatagnier | 166/191 X |
| 4,254,832 | 3/1981 | Patton et al. | 166/147 X |
| 4,357,992 | 11/1982 | Sweeney | 166/191 X |

*Primary Examiner*—Stephen J. Novosad

[57] ABSTRACT

Apparatus for isolating a formation, isolating a damaged section of casing, and for pressure testing the apparatus when located in a cased well bore. The apparatus includes a first packer that is in sealing engagement with the casing for isolating the formation, second and third packers that are spaced to span the damage to the casing, a first valve for closing the passageway through the packers, and a second valve for applying pressure between the first and second packers to test the seals formed thereby. Also provided is an improved method for isolating a damaged section of casing, isolating a formation, and pressure testing the apparatus when located in a cased well bore. The method includes extending the aforementioned apparatus into the well bore, closing the first valve to close the flow through the packers, opening a second valve, and applying pressure to test the seals of the first and second packers. The method also includes the step of applying pressure down an annulus formed between a conduit upon which the apparatus is suspended and the casing to test the seal of the upper packer.

10 Claims, 4 Drawing Figures

METHOD AND APPARATUS FOR THE COMPLETION OF AN OIL OR GAS WELL AND THE LIKE

BACKGROUND OF THE INVENTION

This invention relates generally to improved apparatus and method for the completion of an oil or gas well and the like. More particularly, but not by way of limitation, this invention relates to improved methods and apparatus for the completion of an oil or gas well and the like having a damaged section of casing therein and wherein pressure testing of the apparatus while located in the well bore can be accomplished.

In the completion and recompletion of oil or gas wells and the like, a casing is extended into the well bore, generally cemented therein or at least partially cemented therein, and then production tubing with the necessary packers and other equipment to produce the well extended thereinto and located in the casing. Occasionally, a casing becomes damaged and leaks occur therein which may cause contamination of either the formations or the production fluid.

To complete the well, it is then necessary to isolate the production formation, and isolate the damaged section of the casing therefrom. This has been accomplished in the past by locating a first packer to isolate the formation, then locating second and third packers which were positioned on either side of the damage to the casing to isolate the damaged portion of the casing. When this has been accomplished, the formation can be produced through the tubing or conduit upon which the packers are located. However, there has not been provided apparatus or methods in which each of the seals formed by the packers could be tested to be certain that the formation and the damaged section of a casing are actually isolated.

An object of this invention is to provide an improved method and apparatus for the completion of oil or gas wells and the like wherein the formation can be isolated, the damaged section of casing isolated, and the entire apparatus can be pressure checked while located in the well to be certain that the apparatus has isolated the desired areas.

SUMMARY OF THE INVENTION

This invention provides, in one aspect, improved apparatus for isolating a damaged section of casing, isolating a formation, and pressure testing the apparatus while located in a cased well bore. The apparatus comprises a first packer assembly having a flow passageway therethrough sealingly engaging the casing for isolating the formation, a first valve for closing the passageway through the first packer assembly during testing, and a second packer assembly sealingly engaging the casing and having a flow passageway therethrough. A first conduit connects the first and second packer assemblies with the flow passageways in communication. A second valve is located in the first conduit for permitting flow from the first conduit into an annular space defined by the first and second packer assemblies, the first conduit, and the casing. A third packer assembly is located in sealing engagement with the casing and has a passageway extending therethrough that is connected to the second packer assembly with the passageways in communication. The second and third packer assemblies span the damaged section of the casing for isolating the damaged section. A second conduit is connected to the third packer and extends upwardly through the well bore forming an annulus with the casing wherein pressure may be applied to pressure test the seal of the third packer assembly.

In another aspect, this invention provides an improved method for isolating a damaged section of casing, isolating a formation, and pressure testing apparatus located in a cased well bore. The method comprises positioning apparatus in the cased well bore that includes a first valve located below a first packer, a second valve located in a first conduit between the first packer and second packer, third packer located above the second packer and connected in spaced relationship to the second packer by a distance greater than the length of the damaged section of the casing, and a second conduit connected to the third packer and extending to the surface. The apparatus is positioned with the second and third packers isolating the damage and with the first packer isolating the formation. The method also includes setting the first, second and third packers to form seals with the casing; applying pressure in the annulus formed between the second conduit and the casing to test the seal between the third packer and the casing; closing the first valve; opening the second valve; and applying pressure through the conduits to an annular space defined by the first and second packers, the casing, and the second conduit to test the seals between the first and second packers and the casing.

BRIEF DESCRIPTION OF THE DRAWING

The foregoing and additional objects and advantages of the invention will become more apparent from the following detailed description wherein like reference characters denote like parts in all views and wherein.

DETAILED DESCRIPTION OF THE PREFERRED EMBODIMENT

Figure 1:
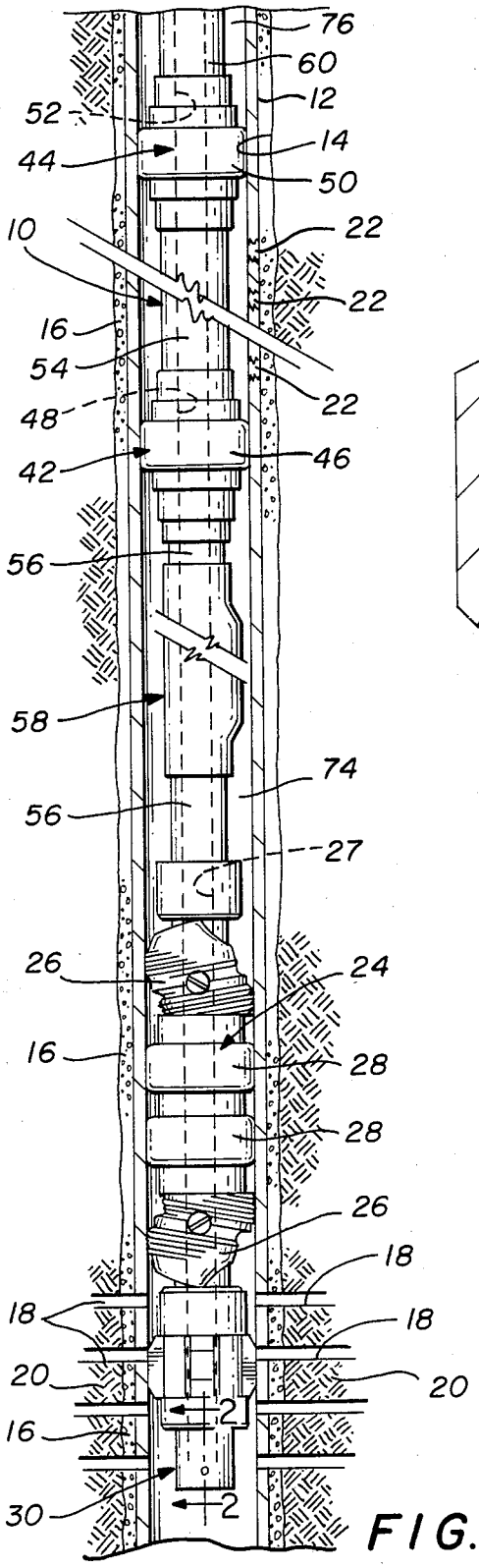
FIG. 1 is a schematic elevation of apparatus that is constructed in accordance with the invention located in a cased well bore shown in cross section.

Referring to the drawing and to FIG. 1 in particular, shown therein and generally designated by the reference character 10, is apparatus constructed in accordance with the invention. The apparatus 10 is illustrated as being disposed within a casing 12 that is located in a well bore 14.

The casing will generally be cemented into the well bore by cementitious material illustrated at 16. Perforations 18 have been formed in the casing 12 and extend through the cementitious material 16 into the oil or gas producing formation 20. Also, it will be noted in FIG. 1 that the casing 12 includes one or more holes 22 that extend therethrough as a result of some casing damage that may permit contamination to occur in the casing 12 or well bore 14. Environmental laws in most areas require that holes 22 be sealed to prevent contamination.

The usual method of sealing the holes 22 is to pump the cement 16 through the casing 12 and into the annular space between the casing 12 and the well bore 14.

Clean up of the interior of the casing 12 is then accomplished as necessary. To make certain that no leaks occur in the damaged area, the apparatus 10 is lowered into the casing 12 and located within the casing 12 as will be described.

The apparatus 10 includes a first or lower packer assembly 24 that is positioned in the casing 12 and set therein with the slips 26 in holding engagement with the casing 12. The packer assembly 24 has a bore or flow passageway 27 extending therethrough. Packing elements 28 are deformed during the setting of the packer 24 so that they form a seal between the packer assembly 24 and the casing 12.

A suitable packer for use as the packer assembly 24 is available in the industry. One such packer assembly is available from the Guiberson Division of Dresser Industries, Inc. and is designated as their ER-VI Packer.

Figure 2:
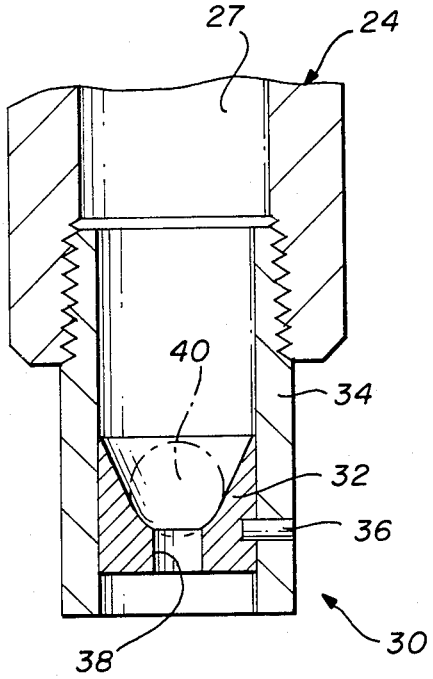
FIG. 2 is an enlarged, fragmentary cross-sectional view of a valve forming part of the apparatus taken generally along the line 2—2 of FIG. 1.

Near its lower end, the packer 24 is connected to a first or lower valve assembly 30 which is shown in more detail in FIG. 2. The valve assembly 30 is located in a position to close the flow passageway 27 in the packer assembly 24.

As shown in FIG. 2, the valve 30 includes an annular valve seat 32 that is retained in a valve housing 34 by a shear pin 36. A flow passageway 38 extends through the seat 32. A valve member or ball 40, which is used to close the passageway 38 is shown by a dash line in FIG. 2. The passageway 38 is closed upon dropping or displacement of the ball 40 onto the seat 32 thereby also preventing flow through the passageway 27 in the packer assembly 24.

The valve assembly 30 is intended to be only one example of a valve that can be used in the method and apparatus of the invention. Other valves are available that can be used in lieu of the valve assembly 30.

In addition to the lower packer assembly 24, the apparatus 10 includes second and third packer assemblies 42 and 44, respectively. The packer assemblies 42 and 44 may be identical in construction and in the preferred form of the invention are identical. Such packers are also available from the oil equipment industry with one such packer being available from the Guiberson Division, Dresser Industries, Inc., and is designated as their Tandem Tension Packer.

As shown in FIG. 1, the packer 42 includes a packing element 46 that is deformable into sealing engagement with the casing 12 when in the set position. The packer assembly 42 has a passageway 48 extending therethrough which is shown in dash lines in FIG. 1.

Similarly, the packer assembly 44 includes a deformable packing element 50 that, when the packer assembly 44 is set, is also deformed into sealing engagement with the casing 12. The packer assembly 44 also includes a flow passageway 52 that extends therethrough as shown in dash lines in FIG. 1.

The packer assembly 42 and the packer assembly 44 are connected by a conduit 54 that is of suitable length to span the damaged area of the casing as illustrated by the reference character 22. The conduit 54 may be of any suitable length so long as it permits location of the packer assemblies 42 and 44 on each side of the damaged area.

Connecting the lower packer assembly 42 with the packer assembly 24 is a conduit 56 having a second or upper valve assembly 58 located therein. The valve assembly 58 is illustrated more clearly in the enlarged cross-sectional view of FIG. 3.

The packer assembly 44 is connected to a conduit or well tubing 60 that extends to the surface of the well bore. The conduit 60 is utilized to suspend the apparatus 10 in the well and also to provide the rotation, and/or vertical movements necessary to set the packer assemblies 24, 42 and 44.

Figure 3:
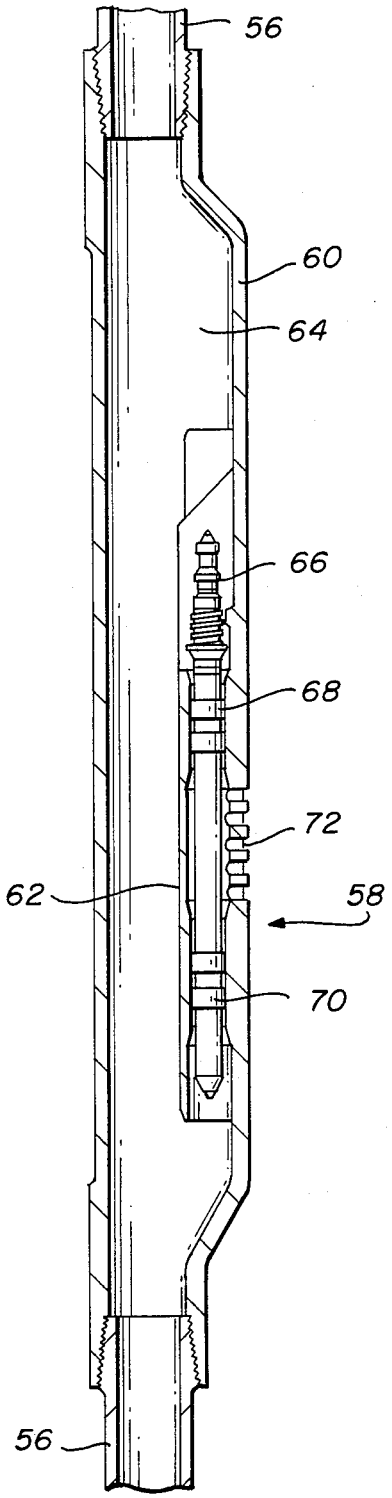
FIG. 3 is an enlarged, fragmentary view illustrating another type of valve that is also used in the invention.

As mentioned hereinbefore, FIG. 3 illustrates in more detail the structure of the valve assembly 58. The valve assembly 58 is connected in the conduit 56 which joins the packer assembly 24 with the packer assembly 42. In the enlarged view of FIG. 3, it can be seen that the valve assembly 58 takes the form of a side pocket mandrel 60. Side pocket mandrels have been used for years in well operations, such as in gas lifts and are manufactured by a number of companies. One suitable product is made by Camco, Incorporated and is designated as the KBMG-LT Side Pocket Mandrel.

The side pocket mandrel 60 includes a pocket 62 that is formed within a passageway 64 extending through the valve assembly 58. The pocket 62 is sized to receive a valve member 66 ports or apertures 72. The ports 72 provide for communication from the interior of the pocket 62 and the side pocket mandrel 60 to an annular space 74 (see FIG. 1). The annular space 74 is defined by the casing 12, the packers 24 and 42, and by the conduit 56 and valve assembly 58.

The valve member 66 can be placed into the pocket 62 and removed therefrom by apparatus and methods well known. With the valve member 66 in place in the pocket 62, the apertures 72 are closed so that the fluid cannot flow from the passageway 64 therein through the port 72.

Figure 4:
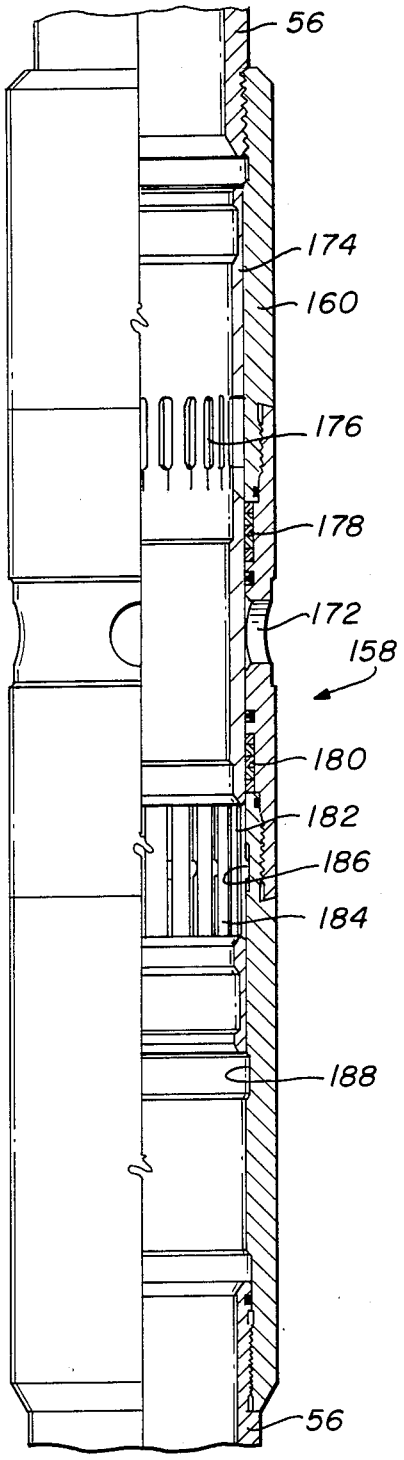
FIG. 4 is an enlarged view, partly in cross-section and partly in elevation of still another type of valve that may be utilized in the apparatus of the invention.

FIG. 4 illustrates another valve assembly that is generally designated by the reference character 158 that may be used in lieu of the valve assembly 58 if desired. As shown, the valve assembly 158 may also be connected in the conduit 56 and includes an outer tubular member 160 having a plurality of ports or apertures 172 extending therethrough. Slidably disposed within the outer tubular member 160 is an inner tubular member 174 that includes a plurality of ports or apertures 176 which are aligned with the ports 172 to permit flow from the interior of the valve assembly 158 therethrough and when misaligned, prevent flow therethrough. Seals 178 and 180 are located on each side of the apertures 172 in engagement with the inner tubular member 174 and thereby forming a seal between the inner and outer tubular members 174 and 160.

The inner tubular member 174 is latched either in the closed position, as illustrated, or in the open position (not shown) by a collet latching apparatus 182 that includes a plurality of flexible collet fingers 184 having protuberances thereon which land in an annular groove 186 formed in the outer tubular member when in the closed position or in an annular groove 188 when the inner tubular member 174 is shifted downwardly to the open position of the valve assembly 158.

Again, the valve assembly 158 is commercially available from Camco, Incorporated under the designation C Series Sliding Sleeve and is operated by apparatus and methods well known in the industry.

Operation of the Preferred Embodiment

In utilizing the apparatus 10 for isolating a damaged section of casing, isolating a formation and pressure testing apparatus located in a cased well bore, the apparatus is assembled and lowered into the casing 12. Once assembled in the arrangement illustrated in FIG. 1, the apparatus 10 is lowered into the well bore until the packer assembly 24 is located in position to isolate the formation 20. As shown, that position is located just above the perforations 18. Appropriate manipulations are transmitted to the packer assembly 24 to set the packer assembly 24 with the packing elements 28 thereon in sealing engagement with the casing 12 and with the slips 26 in holding engagement with the casing so that the packer assembly 24 will not move relative to the casing 12.

With the Guiberson tension packers used as the packer assemblies 42 and 44, upward strain is taken on the conduit 60 causing the packing elements 46 and 50 to deform into tight sealing engagement with the casing 12. When this condition is reached, the packer assemblies 42 and 44 are located in a position to span the damaged section of the casing 12 wherein the holes 22 exist. Tension is retained on the conduit 60 so that the packer assemblies 42 and 44 are held with their packing elements deformed to maintain the seals intact.

With all of the packer assemblies in sealing engagement with the casing 12, pressure testing of the apparatus 10 can begin. The ball 40 is dropped or pumped through the conduit 60 until it lands on the annular seat 32 of the valve assembly 30 as illustrated by the dash lines in FIG. 2. At this point, the passageway 27 through the packer assembly 24 and the passageways extending through the remainder of the apparatus 10 are closed to fluid flow through the valve assembly 30.

After the ball 40 has seated, the valve assembly 58 or 158, depending on which is being used, is manipulated appropriately to open the ports 72 or 172 into the annular space 74. Pressure applied through the passageways in the apparatus 10 is then applied between the packer assembly 24 and the packer assembly 42 in the annular space 74. If the pressure holds, the seals formed by the packing elements 28 and 46 of the packer assemblies 24 and 42, respectively, are intact.

To pressure test the seal of the packing element 50 on the packer assembly 44, pressure is applied in the annular space 76 which is defined by the conduit 60, the casing 12 and the packer assembly 44. If pressure can be applied in the annular space 76 and the pressure holds, it indicates that the seal between the packing element 50 of the packer assembly 44 and the casing 12 is intact. Thus test may be performed either before or after pressure testing the packer assemblies 24 and 42.

From the foregoing, it can be seen that each of the packer assemblies can be checked to determine that proper isolation of the formation 20 has occurred and that the damaged section of the casing 12 has been totally isolated. Thus, not only has the apparatus 10 provided a means of isolating the desired areas in the well bore 14, but it has also provided for the pressure testing of the packing elements to be certain that the desired isolation has occurred.

The foregoing detailed description is presented by way of example only and it will be understood that many changes and modifications can be made thereto without departing from the spirit or scope of the invention.

What is claimed is:

1. Improved apparatus for isolating a damaged section of casing, isolating a formation, and pressure testing the apparatus while located in a cased well bore, said apparatus comprising:

a first packer assembly having a flow passageway therethrough sealingly engaging the casing for isolating the formation;

first valve means for closing the passageway through said first packer assembly during testing;

a second packer assembly sealingly engaging the casing and having a flow passageway therethrough;

first conduit means connecting said first and second packer assemblies with the flow passageways in communication;

second valve means located in said first conduit means for permitting flow from said first conduit means into an annular space defined by said first and second packer assemblies, said first conduit means, and said casing during pressure testing of the seals of said first and second packer assemblies;

a third packer assembly sealingly engaging the casing having a passageway therethrough and connected in spaced relationship to said second packer assembly with said passageways in communication, the distance between said second and third packer assemblies spanning said damaged section of casing for isolating said damaged section; and, second conduit means connected to said third packer and extending upwardly through said well bore forming an annulus with said casing wherein pressure may be applied to pressure test the seal of said third packer assembly.

2. The apparatus of claim 1 wherein said second valve means comprises;

a side pocket mandrel having a port therein communicating with said annular space; and, a valve member located in said mandrel for controlling flow through said port.

3. The apparatus of claim 2 and also including spaced, annular seals on said valve member spanning said port.

4. The apparatus of claim 1 wherein said second valve means comprises:

an outer tubular member having at least one radially extending port in communication with said annular space; and, an inner tubular member moveably located within said outer tubular member having at least one radial port therein for controlling flow through said port.

5. The apparatus of claim 4 and also including annular seals forming spaced seals between said inner and outer tubular members spanning said port.

6. The apparatus of claim 5 and also including:

at least one radial port in said inner tubular member; and, latch means for releasably retaining said inner tubular member in an open position wherein said ports are aligned and in a closed position wherein said ports are out of alignment.

7. A method for isolating a damaged section of casing, isolating a formation, and pressure testing apparatus located in a cased well bore, the method comprising the steps of:

positioning apparatus in the cased well bore, the apparatus including a first valve located below a first packer, a second valve located in a first conduit between said first packer and a second packer, a third packer located above said second packer and connected in spaced relationship to said second packer by a distance greater than length of the damaged section of casing, and a second conduit connected to said third packer and extending to the surface, said apparatus being positioned with the second and third packers isolating the damaged section and with the first packer isolating the formation;

setting said first, second and third packers to form seals with said casing;

applying pressure in the annulus formed between the second conduit and casing to test the seal between said third packer and the casing;

closing said first valve;

opening said second valve; and, applying pressure through said conduits to an annular space defined by said first and second packers, said casing, and said second conduit to test the seals between said first and second packers and said casing.

8. The method of claim 7 wherein the step of setting said packers includes:

setting said first packer to form a seal with said casing isolating said formation; and, applying tension to said conduits to set said second and third packers to form seals with said casing isolating said damaged section of casing.

9. The method of claim 7 and also including the steps of:

releasing the pressure applied for testing the seals;

closing said second valve; and, opening said first valve.

10. The method of claim 8 and also including the steps of:

releasing the pressure applied for testing the seals;

closing said second valve; and, opening said first valve.

* * * * *